United States Patent [19]

North et al.

[11] 4,424,001

[45] Jan. 3, 1984

[54] TIP STRUCTURE FOR COOLED TURBINE ROTOR BLADE

[75] Inventors: William E. North, Concord Township, Delaware County; Augustine C. McClay, Ridley Park, both of Pa.

[73] Assignee: Westinghouse Electric Corp., Pittsburgh, Pa.

[21] Appl. No.: 327,541

[22] Filed: Dec. 4, 1981

[51] Int. Cl.[3] ..... F01D 5/18; F01D 5/20

[52] U.S. Cl. ..... 416/92; 416/96 R; 416/97 R; 415/172 A

[58] Field of Search ..... 416/92, 96 R, 97 R; 415/172 A

[56] References Cited

U.S. PATENT DOCUMENTS

| | | | |
|---|---|---|---|
| 3,533,712 | 10/1970 | Kercher | 416/92 |
| 3,635,585 | 1/1972 | Metzler | 416/92 X |
| 3,876,330 | 4/1975 | Pearson et al. | 416/92 |
| 3,885,886 | 5/1975 | Richter | 416/92 X |
| 3,994,622 | 11/1976 | Schultz et al. | 416/97 R |
| 4,073,599 | 2/1978 | Allen et al. | 416/97 R |
| 4,224,011 | 9/1980 | Dodd et al. | 416/97 |
| 4,326,833 | 4/1982 | Zelahy et al. | 416/96 R |

*Primary Examiner*—Everette A. Powell, Jr.
*Attorney, Agent, or Firm*—E. F. Possessky

[57] ABSTRACT

The invention comprises a cooled turbine rotor blade having an improved blade tip structure. A recessed tip is provided at the leading edge end of the blade tip on downstream turbine blades which are too narrow to support a blade tip cavity over the entire exterior surface of the blade tip without interfering with cooling airflow from apertures in the exterior surface. The recessed tip structure protects apertures therein from blockage by a blade tip smear and does not substantially reduce the performance efficiency of the blade.

3 Claims, 3 Drawing Figures

TIP STRUCTURE FOR COOLED TURBINE ROTOR BLADE

BACKGROUND OF THE INVENTION

The present invention relates generally to combustion turbine rotor blades and more particularly to an improved tip structure for a cooled turbine rotor blade.

It is well established that greater operating efficiency and power output of a combustion turbine may be achieved through higher inlet operating temperatures. Inlet operating temperatures are limited, however, by a maximum temperature tolerable to the rotating turbine blades. Also, as turbine rotor blade temperature increases with increasing inlet gas temperature, the vulnerability of the blades to damage from the tension and stresses which normally accompany blade rotation increases. Cooling the turbine rotor blades, or forming the turbine rotor blades from a temperature resistant material, or both, permits an increase in inlet operating temperatures while keeping turbine blade temperature below the maximum specified operating temperature of the blade material. Generally, as the inlet operating temperatures of typical prior art combustion turbines have been increased, the structure of the first row or first two rows of turbine blades has been altered to permit cooling of these blades so as to enable the blades to withstand the increased temperatures.

In a typical prior art combustion turbine, cooling air drawn from a compressor section of the turbine is directed through channels in the turbine rotor to each of several rotor discs. Passageways within upstream rotor discs communicate the cooling air from the turbine rotor to a blade root at the base of each turbine blade. Generally, cooling air flows from the blade root through an airfoil portion of the cooled blade and exits at least partially through a tip portion of the blade.

A typical prior art, cooled turbine blade tip structure comprises an outwardly facing cavity formed by a radially (with respect to the turbine rotor axis) outward extension of the blade wall surrounding the exterior surface of the blade tip. Cooling air exits into the cavity from apertures in the exterior surface of the blade tip. The tip cavity structure prevents individual exhaust apertures from being sealed by contact between the blade tip and surrounding turbine casing material. Such a blockage, or blade tip smear, could result in turbine blade failure due to reduced cooling air flow through the blade.

As inlet operating temperatures continue to increase to produce still further improvements in turbine operating efficiency, it becomes necessary to cool the turbine blades in downstream blade rows. The blade tip structure utilized to cool upstream turbine blades is not, however, directly applicable to downstream blades due to a difference in blade structure. For aerodynamic reasons, the thickness of turbine blades decreases with each downstream row of blades.

In upstream turbine blade rows, the turbine blade itself is thick enough to support an extension of the blade wall around the entire blade to form a blade tip cavity which extends over the entire exterior blade tip surface. All apertures in the exterior blade tip surface vent cooling air into the cavity. A portion of the blade wall toward a trailing edge on a convex side of the blade can be removed to provide a cooling air exit path from the blade tip cavity. Such structure is described in greater detail in U.S. Pat. No. 3,635,585.

In downstream turbine blade rows, where the thickness of the turbine blade is diminished, there is insufficient clearance between a cooling aperture at a leading edge and the blade wall at the leading edge to support an extension of the blade wall to form the blade tip cavity. Application of the known single blade tip cavity structure to the thinner downstream turbine blades would necessitate rearrangement or elimination of the leading edge cooling channels, thereby subjecting the turbine blade to increased risk of damage due to overheating.

Thus, it appears that prior art turbine blade tip cooling arrangements do not adequately provide for cooling downstream turbine blades.

SUMMARY OF THE INVENTION

Accordingly, a cooled turbine rotor blade comprises an airfoil portion, a root portion, and an improved tip structure which protects cooling air exhaust apertures in an exterior surface of the blade tip from blockage as a result of contact between the blade tip and surrounding turbine casing. The blade tip structure comprises a radially outward extension of the blade walls to surround a substantial portion of the exterior surface of the blade tip, forming a blade tip cavity into which coolant is discharged through apertures in the exterior surface. A leading edge of the airfoil is provided with a recessed tip on the leading exterior side of the blade tip cavity, along a portion of the blade tip where the airfoil is too narrow to support the blade wall extension without obstructing coolant flow from an aperture associated with a coolant passage needed near the leading airfoil edge. This arrangement provides a blade tip structure generally applicable to turbine rotor blades which have a narrow airfoil width. Downstream blades may thereby be cooled, enabling the turbine to be operated at higher inlet temperatures and thereby increasing overall turbine efficiency and performance.

DESCRIPTION OF THE PREFERRED EMBODIMENT

Figure 1:
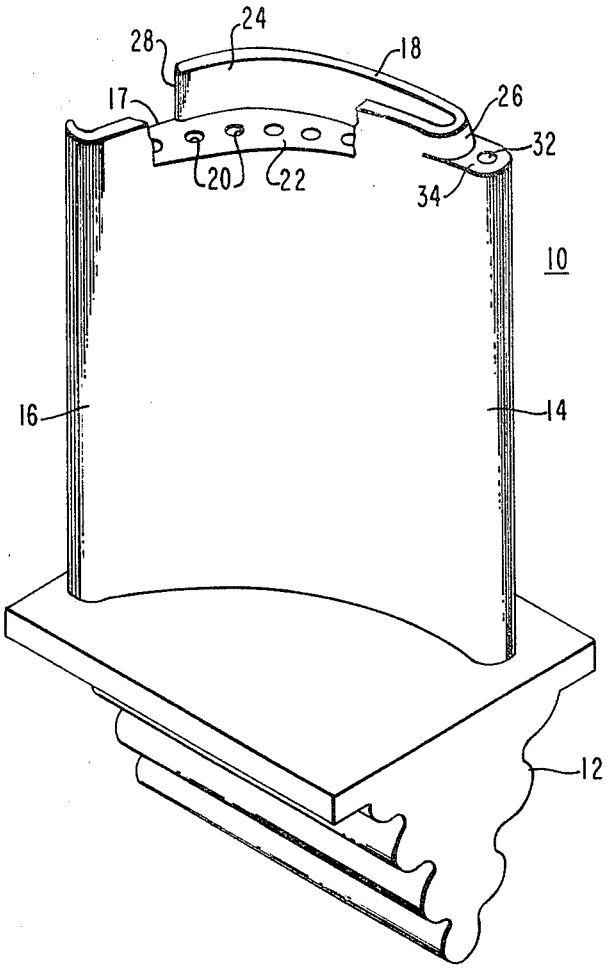
FIG. 1 shows a turbine rotor blade structured according to the principles of the invention.

FIG. 1 depicts a combustion turbine rotor blade 10 comprising a root portion 12 and an airfoil portion 14. The airfoil portion 14 of the blade 10 has a concave side 16, a convex side 17, and a tip portion 18. The root portion 12 of the blade 10 interlocks with a turbine disc (not shown) so as to transform the energy of hot motive gases intercepted by the airfoil portion 14 into rotational motion of the turbine disc and a turbine rotor (not shown) attached rigidly thereto.

In accordance with the principles of the invention, a downstream turbine rotor blade 10 has a blade tip 18 structured to prevent cooling air apertures 20 in an exterior surface 22 of the blade tip from being sealed by a blade tip smear. The blade tip 18 of the turbine rotor blade 10 comprises a blade tip cavity 24 and a recessed tip portion 26 at a leading edge of the airfoil portion 14 of the blade.

The blade tip cavity 24 is formed of a radial (with respect to the turbine rotor axis) extension of turbine blade walls surrounding the exterior surface 22 of the blade tip 18. The blade tip cavity 24 defines an open space of substantially constant pressure into which cooling air exits from apertures 20 in the exterior blade surface 22. A section of the extended blade wall defining the blade tip cavity 24 is removed from the convex side 17 of the airfoil near a trailing edge to enable the cooling air to exit into the discharge path of hot motive gases driving the turbine. The blade tip cavity 24 thus provides means for ensuring a continued flow of cooling air through the blade 10 in the event of contact between the blade tip 18 and the surrounding turbine casing material (not shown).

Figure 3:
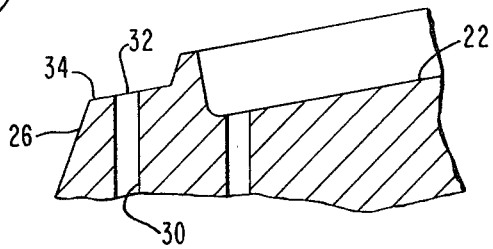
FIG. 3 shows a sectional view of a portion of the airfoil depicted in FIG. 2.
Figure 2:
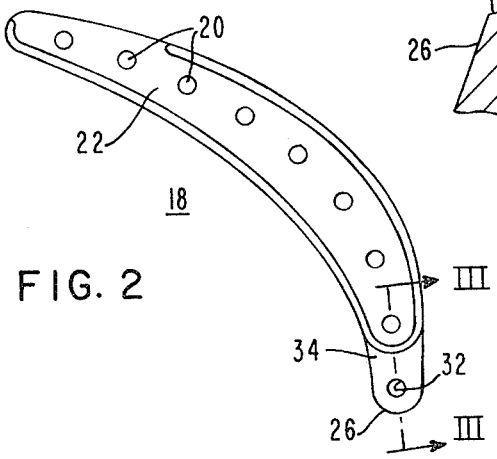
FIG. 2 shows a top view of an airfoil portion of the turbine rotor blade depicted in FIG. 1.

The blade tip 18 further comprises a recessed tip portion 26 at the leading edge of the airfoil 14. The detail of the recessed tip portion 26 is shown in FIGS. 2 and 3. The recessed tip portion 26 provides means for the exit of cooling air from a cooling air channel 30 along the leading edge of the airfoil 14. The combination of a blade tip cavity 24 and the recessed tip portion 26 provides the cooling air exit means necessary to permit the narrower width airfoils of downstream turbine rotor blades to be cooled. The leading edge of the airfoil 14 is too narrow to support an extension of the blade wall without obstructing coolant flow from an aperture associated with the cooling air channel 30 needed near the leading airfoil edge.

The blade tip cavity 24 does not enclose the full exterior surface of the blade tip, excluding a portion of the leading edge exterior surface as necessitated by a narrow blade width at that point. The recessed tip portion 26, with at least one cooling air aperture 32 therein, ensures an adequate flow of cooling air through the leading edge of the airfoil 14 with minimized risk of cooling airflow obstruction due to a blade tip smear.

Any detrimental effect which may result from a slight decrease in working surface area of the airfoil portion 14 is minimized by the upstream position of the recessed tip portion 26. The detrimental effect, if any, may be further minimized by structuring the exterior surface 34 of the recessed tip portion 26 at an intermediate level which is radially beyond the exterior surface 22 within the blade tip cavity 24. The depth of the recessed tip portion 26, as defined by the distance between the radially outermost point of the blade wall and the radially innermost point on the exterior surface of the recessed tip portion 26, may be adjusted as necessary to minimize the amount of airfoil working surface removed and maximize the insurance against a blade tip smear sealing the aperture 32.

What is claimed is:

1. A turbine rotor blade, comprising:

a root portion for securing the blade in a rotor disc;

an airfoil portion having walls contoured to define concave and convex sides for intercepting a flow of hot motive gases;

air channels within the root and airfoil portions for supporting the flow of cooling air therethrough; and a tip portion structured to provide an exhaust path for cooling air from the airfoil portion, said tip portion having:

a tip sidewall extending radially outward from said airfoil portion substantially to bound a radially outward facing tip cavity, said tip sidewall generally having an edge portion extending about the airfoil trailing edge and respective portions generally extending from said sidewall edge portion along said airfoil concave and convex sides toward the airfoil leading edge, and a closing sidewall portion located short of the airfoil leading edge and extending across said airfoil portion between said convex and concave sidewall portions, the base of said tip cavity formed by a blade tip surface having therein apertures for venting cooling air from the airfoil portion into said cavity; and a leading edge tip surface located radially inward from the outermost extent of said tip cavity sidewall and extending from said closing sidewall portion to the airfoil leading edge, said leading edge tip surface having aperture means for venting at least one blade cooling channel near the airfoil leading edge, said leading edge tip surface being too narrow to provide for a sidewall enclosed tip venting cavity without obstructing coolant flow near the airfoil leading edge.

2. A turbine rotor blade according to claim 1 wherein a portion of the extended airfoil wall near a trailing edge is removed to permit the exit of cooling air from said cavity.

3. A turbine rotor blade according to claim 1 wherein said leading edge tip surface is located radially beyond the blade tip surface within said cavity.

* * * * *